US012037730B2

(12) United States Patent
Bondi et al.

(10) Patent No.: US 12,037,730 B2
(45) Date of Patent: Jul. 16, 2024

(54) LAUNDRY APPLIANCE WITH IMPROVED INTENSIVE TREATMENT MODE

(71) Applicant: Electrolux Appliances Aktiebolag, Stockholm (SE)

(72) Inventors: Martino Bondi, Porcia (IT); Paolo Driussi, Porcia (IT); Paolo Quattrin, Porcia (IT); Andrea Zattin, Porcia (IT); Elisa Stabon, Porcia (IT); Andrea Mazzon, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 674 days.

(21) Appl. No.: 17/271,285

(22) PCT Filed: Aug. 23, 2019

(86) PCT No.: PCT/EP2019/072609
§ 371 (c)(1),
(2) Date: Feb. 25, 2021

(87) PCT Pub. No.: WO2020/043620
PCT Pub. Date: Mar. 5, 2020

(65) Prior Publication Data

US 2021/0254255 A1 Aug. 19, 2021

(30) Foreign Application Priority Data

Aug. 30, 2018 (EP) ..... 18191678

(51) Int. Cl.
*D06F 33/37* (2020.01)
*D06F 23/02* (2006.01)
(Continued)

(52) U.S. Cl.
CPC ..... *D06F 33/37* (2020.02); *D06F 23/02* (2013.01); *D06F 34/04* (2020.02); *D06F 34/28* (2020.02);
(Continued)

(58) Field of Classification Search
CPC ..... D06F 33/37
See application file for complete search history.

(56) References Cited

U.S. PATENT DOCUMENTS

2012/0266387 A1 10/2012 Pollett et al.

FOREIGN PATENT DOCUMENTS

EP 2441871 A2 4/2012
EP 2860295 A1 4/2015
(Continued)

OTHER PUBLICATIONS

International Search Report and Written Opinion for International Application No. PCT/EP2019/072609, dated Oct. 24, 2019, 10 pages.

*Primary Examiner* — Jason Y Ko
(74) *Attorney, Agent, or Firm* — Bradley Arant Boult Cummings LLP

(57) ABSTRACT

A laundry appliance having a treatment chamber and a control unit configured to perform a first set of phases of a selected treatment cycle using a dose of a treatment agent, and a treatment agent delivering device. The control unit is further configured to: receive a first command that enables the delivering device and thereupon: calculate a first amount of treatment agent, and cause the delivering device to deliver the dose to the laundry treatment chamber; and, upon receiving a second command for an intensive treatment mode: cause the laundry appliance to perform a second set of phases in addition to said first set of phases, and calculate a second amount of treatment agent when both the first and
(Continued)

second commands are received, so that said dose comprises said first amount of treatment agent plus said second amount of treatment agent.

19 Claims, 9 Drawing Sheets

(51) Int. Cl.

| | |
|---|---|
| ***D06F 34/04*** | (2020.01) |
| ***D06F 34/28*** | (2020.01) |
| *D06F 34/05* | (2020.01) |
| *D06F 39/02* | (2006.01) |
| *D06F 101/20* | (2020.01) |
| *D06F 103/02* | (2020.01) |
| *D06F 103/04* | (2020.01) |
| *D06F 105/42* | (2020.01) |
| *D06F 105/52* | (2020.01) |

(52) U.S. Cl.
CPC ..... *D06F 34/05* (2020.02); *D06F 39/02* (2013.01); *D06F 39/022* (2013.01); *D06F 2101/20* (2020.02); *D06F 2103/02* (2020.02); *D06F 2103/04* (2020.02); *D06F 2105/42* (2020.02); *D06F 2105/52* (2020.02)

(56) References Cited

FOREIGN PATENT DOCUMENTS

| | | | | |
|---|---|---|---|---|
| EP | 3141651 A1 * | 3/2017 | ..... | C02F 1/008 |
| EP | 3141651 A1 | 3/2017 | | |

* cited by examiner manual dosing functionality;
intensive treatment mode disabled manual dosing functionality;
intensive treatment mode enabled auto dosing functionality;
intensive treatment mode disabled auto dosing functionality;
intensive treatment mode enabled

LAUNDRY APPLIANCE WITH IMPROVED INTENSIVE TREATMENT MODE

This application is a U.S. National Phase application of PCT International Application No. PCT/EP2019/072609, filed Aug. 23, 2019, which claims the benefit of European Application No. 18191678.4, filed Aug. 30, 2018, both of which are incorporated by reference herein.

FIELD OF THE INVENTION

The present invention relates to the field of laundry treatment appliances (hereinafter, concisely, "laundry appliances"), and particularly to laundry appliances for treating, e.g. washing, items (such as linen, clothes, garments, shoes, and the like), such as laundry washing machines and laundry washing machines also implementing laundry drying functions (also referred to as washers/dryers).

BACKGROUND OF THE INVENTION

In order to perform treatment cycles (e.g., comprising washing, rinsing and draining phases) on laundry located in the laundry treatment chamber of a laundry appliance, water and laundry treatment agents (such as liquid and powder treatment agents, hereinafter simply referred to as "treatment agents") should be fed into the laundry treatment chamber in a controlled way during the various phases of the treatment cycles.

For this reason, a laundry appliance typically comprises a drawer having drawer compartments for containing one or more of said treatment agents. The laundry appliance is configured to deliver doses comprising selected amounts of such treatment agents contained in the drawer compartments into the laundry treatment chamber, mixed with proper amounts of water.

In addition to, or in the place of drawer compartments adapted to contain a single dose of a respective treatment agent for performing a single treatment cycle (hereinafter referred to as mono-dose compartments), in an increasingly common type of laundry appliance, the drawer comprises one or more compartments each one adapted to contain multiple doses of a respective treatment agent for performing multiple treatment cycles (hereinafter referred to as multi-dose compartments). Just as an example, in case of two multi-dose compartments, a multi-dose compartment may be arranged to contain multiple doses of a liquid washing detergent, whereas the other multi-dose compartment may be arranged to contain multiple doses of a liquid softener. In this class of laundry appliance, the laundry appliance may implement an auto-dosing functionality in which, at each treatment cycle (and when the auto-dosing functionality is enabled), a dose of treatment agent is automatically taken (e.g., by means of a pumping apparatus) from the multi-dose compartment(s) and dispensed to the laundry treatment chamber through proper channels together with water supplied by a water distribution system of the laundry appliance.

Commonly, laundry appliances provide users with the possibility of selecting the treatment cycle to be carried out among a set of predetermined treatment cycles, wherein each one of the predetermined treatment cycle corresponds to a different sequence of (e.g., washing, rinsing, draining, heating, tumbling, spinning . . . ) phases, with each one of said phases that may have in general different predetermined parameters (e.g., phase duration, water temperature, water amount, tumbling speed, spinning speed, . . . ).

It is also known to provide laundry appliances with the possibility of selectively activating an "intensive treatment mode" according to which the selected treatment cycle is enriched with the addition of further phases (such as for example additional phases in which water is loaded in the laundry treatment chamber, additional tumbling phases, additional phases in which the water is heated to a higher temperature, . . . ) in case the laundry located in the laundry treatment chamber is particularly dirty.

SUMMARY OF INVENTION

Applicant has realized that the presently available laundry appliances provided with multi-dose compartments cannot efficiently exploit the abovementioned intensive treatment mode.

Indeed, the known solutions simply provide for indiscriminately apply the same intensive treatment mode regardless of the mono-dose compartments or the multi-dose compartments are employed, e.g., without taking into considerations that using mono-dose or multi-dose compartments implies different operative constraints in the laundry appliance operation which may impair the advantages the intensive treatment mode is potentially able to offer.

Moreover, the presently available laundry appliances provided with both multi-dose and mono-dose compartments require very complicated user interfaces comprising a high number of input selectors, some dedicated to input commands when the auto-dosing functionality is enabled and some dedicated to input commands when the auto-dosing functionality is disabled. Users of these laundry appliances may therefore be confused because of this high number of input selectors. Furthermore, with the very complicated user interfaces of these presently available laundry appliances, there is also the possibility of confusing input selectors dedicated to the auto-dosing functionality with input selectors dedicated to the intensive treatment mode.

In view of the above, applicant has devised a solution for allowing users of a laundry appliance provided with multi-dose compartments to proficiently exploit the abovementioned intensive treatment mode in a simple and efficient way, at the same time avoiding any possibility of confusion.

An aspect of the present invention relates to a laundry appliance.

According to an embodiment of the present invention, the laundry appliance comprises a laundry treatment chamber adapted to receive laundry.

According to an embodiment of the present invention, the laundry appliance comprises a control unit configured to, for a selected treatment cycle among a set of treatment cycles, cause the laundry appliance to perform a first set of phases of the selected treatment cycle for treating the laundry located in the laundry treatment chamber exploiting a dose of a treatment agent.

According to an embodiment of the present invention, the laundry appliance comprises a treatment agent delivering device configured to store an amount of a treatment agent sufficient for performing a plurality of said treatment cycles and to deliver the treatment agent when enabled.

According to an embodiment of the present invention, the the control unit is further configured to, upon receiving a first command that enables the treatment agent delivering device:

calculate a first amount of treatment agent based on an operative condition of the laundry appliance, said dose comprising said first amount of treatment agent, and cause the treatment agent delivering device to draw up from the stored amount of treatment agent said dose and to deliver it to the laundry treatment chamber;

According to an embodiment of the present invention, the control unit is further configured to, upon receiving a second command that enables an intensive treatment mode, cause the laundry appliance to perform a second set of phases for treating the laundry in addition to said first set of phases.

According to an embodiment of the present invention, the control unit is further configured to calculate a second amount of treatment agent when both the first and second commands are received, so that, when both the first and second commands are received, said dose comprises said first amount of treatment agent plus said second amount of treatment agent.

According to an embodiment of the present invention, the the control unit is further configured to calculate said first amount of treatment agent based on at least one among:

an indication/estimation/measure of the weight of the laundry located in the laundry treatment chamber;

the selected treatment cycle;

a predetermined base amount of treatment agent;

an indication/estimation/measure of a laundry dirt degree.

According to an embodiment of the present invention, the the control unit is further configured to calculate said second amount of treatment agent for setting it to a value based on the calculated first amount of treatment agent.

According to an embodiment of the present invention, the the control unit is further configured to calculate said second amount of treatment agent for setting it to a value corresponding to a percentage, preferably between 5% and 40%, and more preferably between 15% and 25%, of the calculated first amount of treatment agent.

According to an embodiment of the present invention, said first set of phases of the selected treatment cycle comprises:

a water load phase in which water is delivered to the laundry treatment chamber;

a treatment phase in which laundry located in the laundry treatment chamber, together with said water delivered in the water load phase and by exploiting said dose, is treated by means of tumbling.

According to an embodiment of the present invention, said treatment agent delivering device comprises at least one multi-dose compartment configured to store an amount of said treatment agent corresponding to multiple doses.

According to an embodiment of the present invention, said treatment agent delivering device comprises at least one pump unit configured to draw up said dose from at least one the compartment to deliver it to the laundry treatment chamber.

According to an embodiment of the present invention, the laundry appliance further comprises at least one mono-dose treatment agent storage compartment having a treatment agent storing capacity corresponding to at least said dose.

According to an embodiment of the present invention, the control unit is configured to cause the content of the mono-dose treatment agent storage compartment to be delivered to the laundry treatment chamber to be exploited for performing the first set of phases of the selected treatment cycle when the treatment agent delivering device is not enabled.

According to an embodiment of the present invention, said second set of phases of the selected treatment cycle comprises at least one of:

a first subset of phases comprising at least one additional water load phases to be carried out before said water load phase, and a second subset of phases comprising at least one further additional phase in which water in the laundry treatment chamber is heated and/or laundry in the laundry treatment chamber is tumbled after said water load phase and before said treatment phase.

According to an embodiment of the present invention, the laundry appliance further comprises a compartment adapted to contain an amount of a further treatment agent.

According to an embodiment of the present invention, the control unit is configured to deliver said amount of the further treatment agent into the laundry treatment chamber in a selected one among said first subset and said second subset of phases.

According to an embodiment of the present invention, said treatment agent is laundry detergent.

According to an embodiment of the present invention, said further treatment agent is laundry bleach.

According to an embodiment of the present invention, the laundry appliance further comprises a user interface comprising a first and a second input selectors.

According to an embodiment of the present invention, the control unit being is configured to receive said first and second commands by means of an interaction of an user with said first and second input selectors, respectively.

According to an embodiment of the present invention, the control unit is configured to receive at least one between the first and the second commands through an external device being external to the laundry appliance.

According to an embodiment of the present invention, the laundry appliance further comprises a sensor unit adapted to sense a dirt level of the laundry located inside the laundry treatment chamber, and to send the second command to the control unit when the sensed dirt level is higher than a corresponding threshold.

According to an embodiment of the present invention, the laundry appliance further comprises a heating resistor provided at the bottom of the laundry treatment chamber and adapted to be activated by the control unit for heating water mixed with treatment agent.

According to an embodiment of the present invention, the laundry appliance further comprises a mixing recirculation circuit.

According to an embodiment of the present invention, the mixing recirculation circuit comprises a mixing input recirculation duct fluidly coupled with the laundry treatment chamber through a discharge hole provided at the bottom of the laundry treatment chamber and connected to a mixing recirculation pump operable to cause the liquid located in the mixing input recirculation duct to be conveyed to a mixing output recirculation duct which is fluidly coupled with the bottom portion of the laundry treatment chamber where the heating resistor is located.

According to an embodiment of the present invention, the laundry appliance comprises a soaking recirculation circuit.

According to an embodiment of the present invention, the soaking recirculation circuit comprises a soaking input recirculation duct fluidly coupled with the laundry treatment chamber through the discharge hole provided at the bottom of the laundry treatment chamber and connected to a soaking recirculation pump operable to cause the liquid located in the soaking input recirculation duct to be conveyed to a soaking output recirculation duct which is fluidly coupled with the top portion of the laundry treatment chamber.

According to an embodiment of the present invention, the laundry appliance comprises both the mixing recirculation circuit and the soaking recirculation circuit.

According to another embodiment of the present invention, the laundry appliance comprises one between the mixing recirculation circuit and the soaking recirculation circuit.

According to an embodiment of the present invention the soaking output recirculation duct is fluidly coupled with the top portion of the laundry treatment chamber through a nozzle device.

According to an embodiment of the present invention, the control unit is configured to activate the mixing recirculation pump during at least a portion of the first subset of phases.

According to an embodiment of the present invention, the control unit is configured to activate the mixing recirculation pump during at least a portion of the second subset of phases.

According to an embodiment of the present invention, the control unit is configured to activate the soaking recirculation pump during at least a portion of the second subset of phases.

Another aspect of the present invention relates to a method for operating a laundry appliance.

According to an embodiment of the present invention, the laundry appliance comprises a laundry treatment chamber adapted to receive laundry.

According to an embodiment of the present invention, the laundry appliance comprises a control unit configured to, for a selected treatment cycle among a set of treatment cycles, cause the laundry appliance to perform a first set of phases of the selected treatment cycle for treating the laundry located in the laundry treatment chamber exploiting a dose of a treatment agent.

According to an embodiment of the present invention, the laundry appliance comprises a treatment agent delivering device configured to store an amount of said treatment agent sufficient for performing a plurality of treatment cycles and to deliver the treatment agent when enabled.

According to an embodiment of the present invention, the method comprises having the control unit perform, upon receiving a first command enabling the treatment agent delivering device:

calculating a first amount of treatment agent based on an operative condition of the laundry appliance, said dose comprising said first amount of treatment agent, and causing the treatment agent delivering device to draw up from the stored amount of treatment agent said dose and to deliver it to the laundry treatment chamber;

According to an embodiment of the present invention, the method comprises having the control unit perform, upon receiving a second command that enables an intensive treatment mode, causing the laundry appliance to perform a second set of phases for treating the laundry in addition to said first set of phases.

According to an embodiment of the present invention, the method comprises having the control unit calculating a second amount of treatment agent when both the first and second commands are received, so that, when both the first and second commands are received, said dose comprises said first amount of treatment agent plus said second amount of treatment agent.

According to an embodiment of the present invention, the method further comprises having the control unit calculate said first amount of treatment agent based on at least one among:

an indication/estimation/measure of the weight of the laundry located in the laundry treatment chamber;

the selected treatment cycle;

a predetermined base amount of treatment agent;

an indication/estimation/measure of a laundry dirt degree.

According to an embodiment of the present invention, the method further comprises having the control unit calculate said second amount of treatment agent for setting it to a value based on the calculated first amount of treatment agent.

According to an embodiment of the present invention, the method further comprises having the control unit calculate said second amount of treatment agent for setting it to a value corresponding to a percentage, preferably between 5% and 40%, and more preferably between 15% and 25%, of the calculated first amount of treatment agent.

According to an embodiment of the present invention, said treatment agent delivering device comprises at least one multi-dose compartment configured to store an amount of said treatment agent corresponding to multiple doses.

According to an embodiment of the present invention, said treatment agent delivering device comprises at least one pump unit configured to draw up said dose from at least one the compartment to deliver it to the laundry treatment chamber.

According to an embodiment of the present invention, the laundry appliance further comprises at least one mono-dose treatment agent storage compartment having a treatment agent storing capacity corresponding to said dose.

According to an embodiment of the present invention, the method further comprises having the control unit cause the content of the mono-dose treatment agent storage compartment to be delivered to the laundry treatment chamber to be exploited for performing the first set of phases of the selected treatment cycle when the treatment agent delivering device is not enabled.

According to an embodiment of the present invention, said first set of phases of the selected treatment cycle comprises a water load phase in which water is delivered to the laundry treatment chamber.

According to an embodiment of the present invention, said first set of phases of the selected treatment cycle comprises a treatment phase in which laundry located in the laundry treatment chamber, together with said water delivered in the water load phase and by exploiting said dose, is treated by means of tumbling.

According to an embodiment of the present invention, said second set of phases of the selected treatment cycle comprises at least one of:

a first subset of phases comprising at least one additional water load phases to be carried out before said water load phase, and a second subset of phases comprising at least one further additional phase in which water in the laundry treatment chamber is heated and/or laundry in the laundry treatment chamber is tumbled after said water load phase and before said treatment phase.

According to an embodiment of the present invention, the laundry appliance further comprises a compartment adapted to contain an amount of a further treatment agent.

According to an embodiment of the present invention, the method further comprises having the control unit deliver said amount of the further treatment agent into the laundry treatment chamber in a selected one among said first subset and said second subset of phases.

According to an embodiment of the present invention, said treatment agent is laundry detergent.

According to an embodiment of the present invention, said further treatment agent is laundry bleach.

According to an embodiment of the present invention, the laundry appliance comprises a user interface comprising a first and a second input selectors.

According to an embodiment of the present invention, the method further comprises having the control unit receive said first and second commands by means of an interaction of an user with said first and second input selectors, respectively.

According to an embodiment of the present invention, the method further comprises having the control unit receive at least one between the first and the second commands through an external device being external to the laundry appliance.

According to an embodiment of the present invention, the laundry appliance further comprises a sensor unit adapted to sense a dirt level of the laundry located inside the laundry treatment chamber.

According to an embodiment of the present invention, the method further comprises having the sensor unit send the second command to the control unit when the sensed dirt level is higher than a corresponding threshold.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
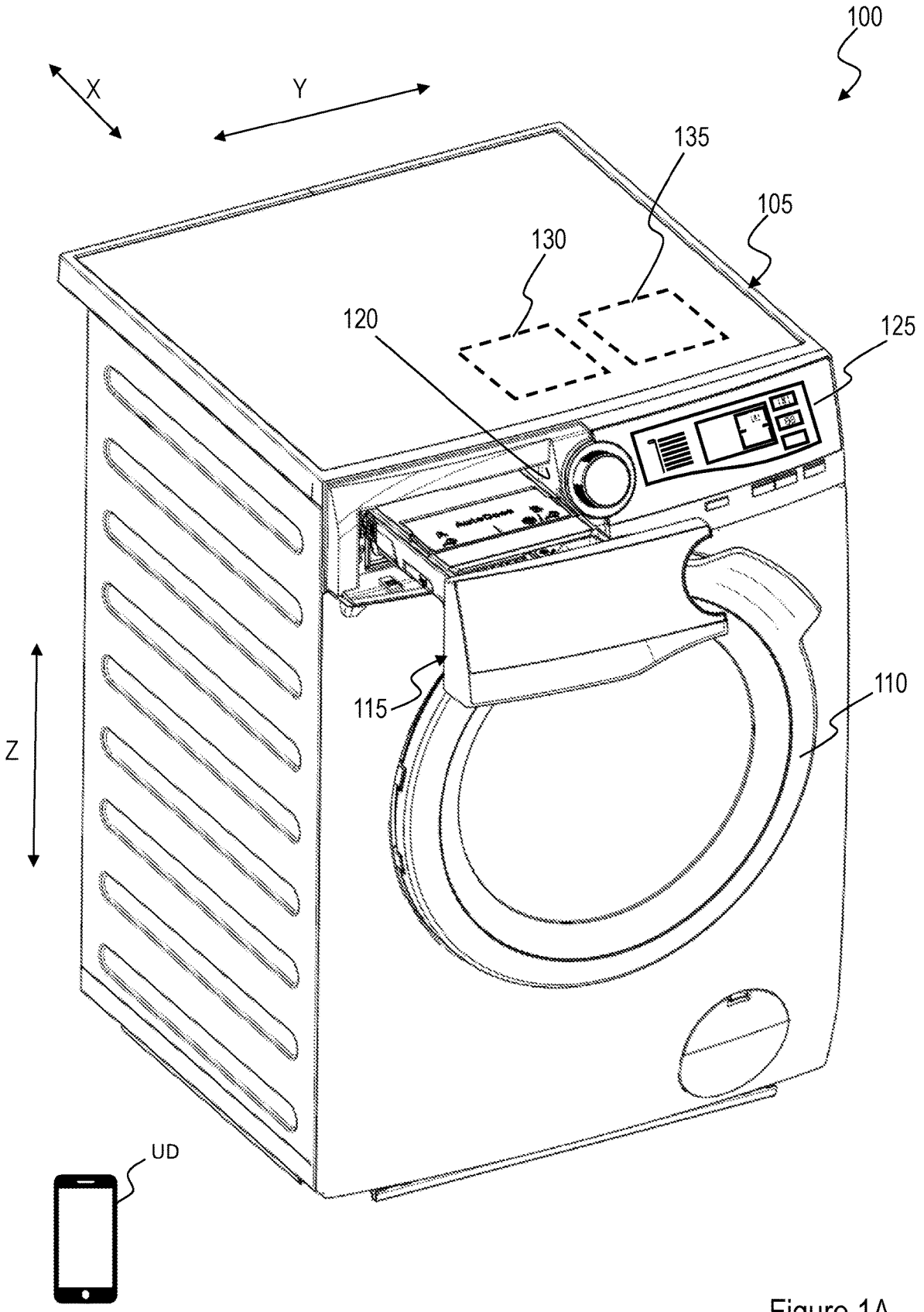
FIGS. 1A and 1B show perspective views of a laundry appliance according to an embodiment of the present invention.
Figure 1B:
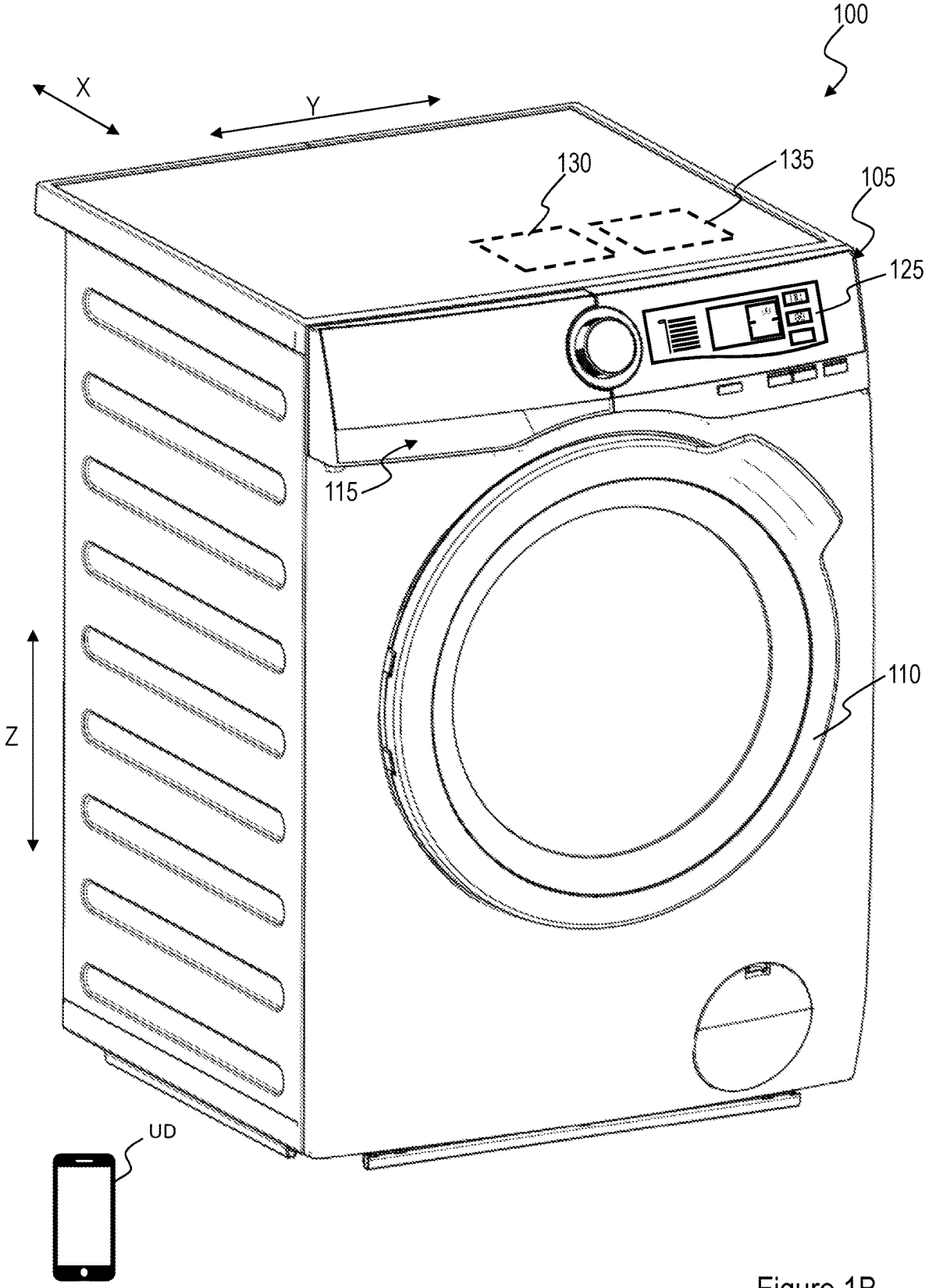

With reference to the drawings, sharing the same reference system identified by the three orthogonal directions x, y and z, FIGS. 1A and 1B show perspective views of a laundry appliance 100 according to an embodiment of the present invention. According to the exemplary, not limiting, embodiment herein considered, the laundry appliance 100 is a washing machine. In any case, although in the following description explicit reference will be made to a washing machine, this should not to be construed as a limitation; indeed, the present invention applies to other types of laundry appliances (for example combined washers/dryers, i.e. washing machines also having laundry drying functions). In operation, the laundry appliance 100 rests on a rest surface, such as the floor, parallel to directions x and y, and uprightly extends from it along direction z.

The laundry appliance 100 comprises a (e.g., parallepiped-shaped) cabinet 105, which preferably accommodates a laundry treatment chamber (i.e., a laundry washing chamber in the example herein considered of a washing machine) for performing a treatment cycle on items housed therein (i.e., a treatment cycle on a laundry load in the example herein considered of a washing machine).

The laundry treatment chamber (also simply referred to as treatment chamber) preferably comprises a washing tub (not shown) and, within it, a (e.g., rotatable) washing basket or drum (not shown) adapted to contain the laundry load to be washed. A cabinet front has a loading opening providing an access to the drum for loading/unloading the laundry load, a door 110 (shown in a closed position in FIGS. 1A and 1B) being provided for sealably closing the loading opening during the operation of the laundry appliance 100.

Although not shown, the laundry appliance 100 also comprises, enclosed in the cabinet 105, electrical/electronic/mechanical/hydraulic components for the operation of the laundry appliance 100 (such as for example motor, electromechanical valves, pumps and impellers of the hydraulic apparatus, one or more heating elements for heating water/treatment agents/air).

The laundry appliance 100 further comprises a storage drawer 115 (briefly, or, concisely, drawer) for containing one or more treatment agents, such as liquid and powder treatment agents including, but not limited to, washing detergents, rinsing detergents, bleaches and softeners. The cabinet 105 comprises a drawer seat 120 (preferably provided on a top part of a cabinet front) for housing the drawer 115, the drawer being advantageously adapted to slide within the drawer seat 120, along a longitudinal or sliding direction, between an extracted position (shown in FIG. 1A) and a retracted position (shown in FIG. 1B). The sliding direction is for example parallel to direction x, or may be slightly slanted with respect thereto.

As already mentioned in the introduction, by retracted position of the drawer 115 it is intended a position in which the drawer 115 is (fully) retracted inside the drawer seat 120 (as in the situation illustrated in FIG. 1B), while by extracted position of the drawer 115, it is intended a position in which the drawer 115 is at least partially extracted from the drawer seat 120 and preferably, but not necessarily, protrudes from the cabinet 105 (as in the situation illustrated in FIG. 1A).

Preferably, the laundry appliance 100 further comprises a user interface 125, the user interface 125 being preferably provided on the top part of the cabinet front, more preferably next to the drawer seat 120 along direction y.

Preferably, although not necessarily, the user interface 125 comprises a display unit, for visually displaying one or more pieces of information; the display unit may for example be a light emitting polymer display (LPD), a liquid crystal display, a thin film transistor-liquid crystal display, or an organic light-emitting diode display.

The user interface 125 preferably comprises one or more input selectors—e.g. buttons/cursors/sliders/knobs—for allowing the user to select a treatment cycle among a set of predetermined treatment cycles and to set one or more parameters of the selected treatment cycle, as will be described in greater detail in the following of the present description. The input selectors may be physical selectors (i.e. whose activation/deactivation is associated with displacements of mechanical components) and/or virtual selectors (i.e., whose activation/deactivation is associated with touch-sensitive electric components).

Additionally, as herein exemplary assumed, or alternatively, the user interface 125 preferably comprises one or more status indicators for showing to the user an operative condition of the laundry appliance 100 by indicating a status of one or more components of the laundry appliances 100 and/or a status of the treatment cycle (including, but not limited to, information about a residual time to the end of the ongoing treatment cycle, and/or information about a current phase of the ongoing treatment cycle, and/or selected parameters for the ongoing treatment cycle, and/or selected drawer compartment, and/or selected treatment agent).

The laundry appliance 100 is advantageously equipped with a laundry appliance control unit 130 (briefly, or concisely, control unit) comprising logic and computational modules, power supply modules, driving modules, power regulators and generally all the electric and electronic components which are responsible for the driving, control, and supply of the electrical/electronic/mechanical/hydraulic components of the laundry appliance 100. Advantageously, the control unit 130 is particularly configured to drive, control and supply the electrical/electronic/mechanical/hydraulic components of the laundry appliance 100 according to the selected treatment cycle and according to parameters thereof set through the user interface 125.

As illustrated in FIGS. 1A and 1B, the laundry appliance 100 preferably comprises a connection unit 135 (for example a network interface controller or network adapter, schematically illustrated as a dashed rectangle in the figures) for allowing a (e.g., wired or wireless) data exchange between the laundry appliance 100 and an external device, for example a user device UD, being external to the laundry appliance 100. The user device UD may for example be a personal digital assistant (PDA), a smartphone (as herein exemplary illustrated), a tablet, a wearable smart device (such as a smartwatch) or other mobile device having processing, input/output and memory units adapted to run software applications (i.e. mobile applications in the example at issue of a smartphone as user device UD). The mobile application run by (i.e., running on) the user device UD is advantageously adapted to present to the user at least a subset of functionalities and/or settings and/or options and/or operation modes allowed by user interface 125.

Figure 2A:
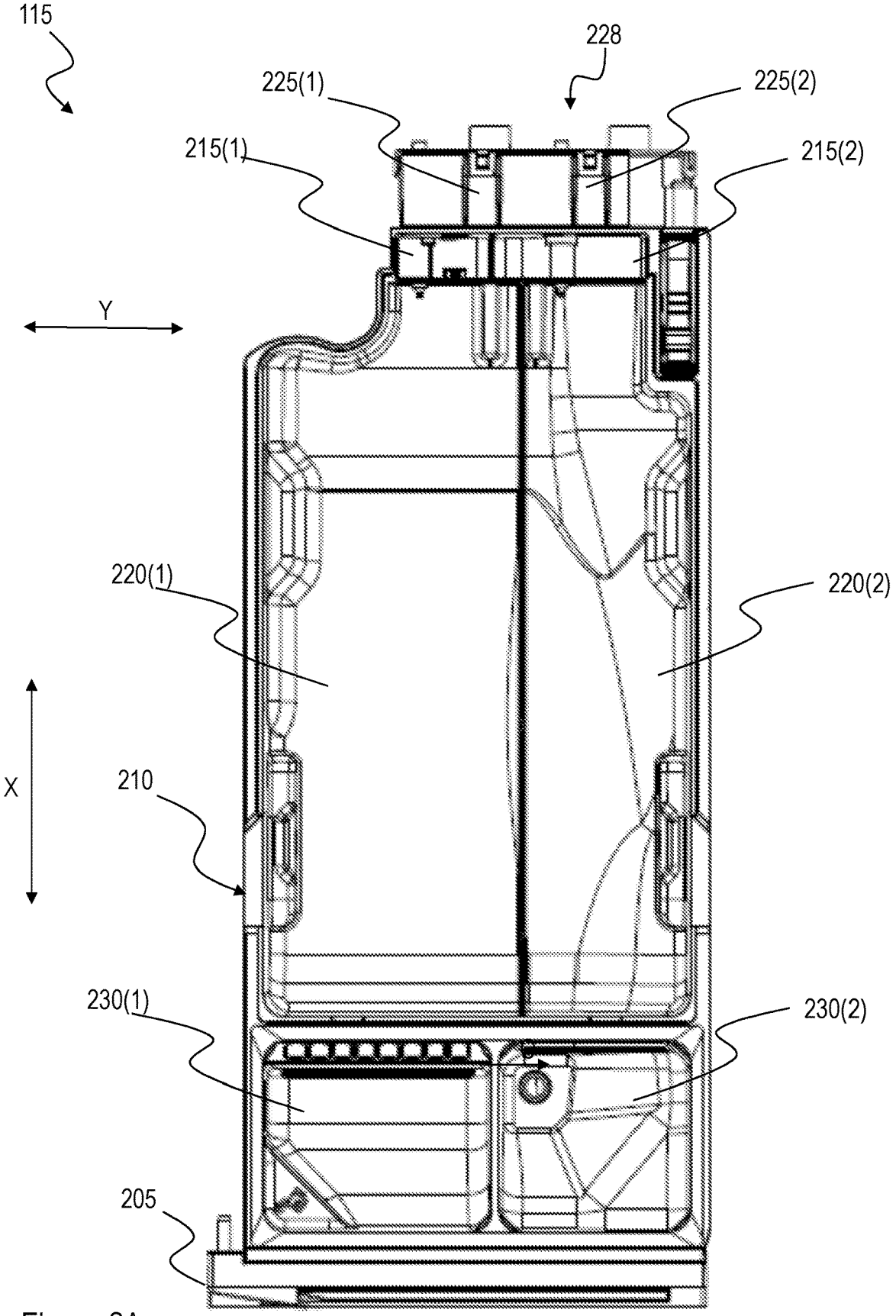
FIG. 2A shows a top view of a drawer of the laundry appliance according to an embodiment of the present invention.

With reference now also to FIG. 2A, it shows a top view of the drawer 115 according to an embodiment of the present invention. For ease of description, FIG. 2A will be discussed together with FIG. 2B, which shows a perspective view of the drawer 115 in the extracted position, wherein the drawer 115 is partially extracted from the drawer seat 120.

The drawer 115 preferably comprises a drawer handle 205 allowing the user to slidably move the drawer 115 between the extracted position and the retracted position when it is fitted in the drawer seat 120, and a drawer body 210 to which the drawer handle 205 is adapted to be mounted or coupled or connected (for example, in a removable or reversible way). When the laundry appliance 100 is installed and the drawer 115 is fitted in the drawer seat 120, the drawer handle 205 preferably identifies, along direction x, a drawer front (which advantageously forms part of the cabinet front when the drawer 115 is in the retracted position).

The drawer 115 preferably comprises, along direction x (from the drawer front backwards):

behind the handle 205, and hence in the drawer body 210, one or more (two, in the example at issue) drawer compartments 220(1),220(2) each one adapted to contain an amount of a respective treatment agent sufficient for performing a plurality of treatment cycles, hereinafter referred to as multi-dose compartments 220(1), 220(2); each multi-dose compartment 220(1), 220(2) is provided with a top opening for the loading of treatment agent from above. Just as an example, the multi-dose compartment 220(1) may be arranged to contain a washing detergent, whereas the multi-dose compartment 220(2) may be arranged to contain a liquid softener;

behind the multi-dose compartments 220(1),220(2), and hence in the drawer body 210, one or more (two, in the example at issue) channels 215(1),215(2) associated with the multi-dose compartments 220(1),220(2) (in the example herein considered, each channel 215(1), 215(2) is associated with a respective one of the multi-dose compartments 220(1),220(2), the channel 215(1) being for example associated with the multi-dose compartment 220(1) and the channel 215(2) being for example associated with the multi-dose compartment 220(2)). Each channel 215(1),215(2) is preferably adapted to channel water and/or treatment agent amounts towards a region of the drawer seat 120 that allows a mixture between the water and treatment agent (hereinafter referred to as mixing region): the mixing region may for example be or comprise a bottom wall 220(BW) of the drawer seat 120 (visible in FIG. 2B), the bottom wall 220(BW) of the drawer seat 120 being advantageously slanted in order to promote a flow of the mixture between the water and the treatment agent dose(s) towards the treatment chamber of the laundry appliance 100. Advantageously, the channels 215(1), 215(2) (or at least one thereof) extend vertically with respect to the rest surface (such as the floor) on which the laundry appliance 100 rests in operation (the channels 215(1),215(2) thus extending substantially along direction z). In alternative embodiments of the present invention, the channels 215(1),215(2) (or at least one thereof) are inclined with respect to the rest surface (such as the floor) on which the laundry appliance 100 rests in operation. Regardless of the specific (vertical or inclined) orientation of the channels 215(1),215(2), which is not limiting for the present invention, each channel 215(1),215(2) is structured and shaped such as to allow the water and/or the treatment agent to fall towards the mixing region of the drawer seat 120 by gravity; in order to achieve it, each channel 215(1),215(2) advantageously comprises a top channel input for receiving the water from a water distribution system above it (not illustrated) and a bottom channel output facing the bottom wall 220(BW) of the drawer seat 120; in operation the bottom channel outputs of the channels 215(1),215(2) are arranged for delivering the water and the treatment agent to the bottom wall 220(BW) of the drawer seat 120, and hence to the treatment chamber of the laundry appliance 100. Having two separate channels 215(1),215(2) each one associated with a respective multi-dose compartment 220(1),220(2) is particularly advantageous in the preferred embodiment herein considered in which the multi-dose compartments 220(1),220(2) store different types of treatment agents (e.g., liquid washing detergent and liquid softener); in fact, in this way, a mixing between the two different types of treatment agents due to the presence of treatment agent residues from channel walls is avoided;

behind the channels 215(1),215(2), and hence in the drawer body 210, one or more (two, in the example at issue) pump actuation parts 225(1),225(2) of a pumping system configured to take predetermined amounts of treatment agent from one or both of the multi-dose compartments 220(1),220(2). The pump actuation parts 225(1),225(2) preferably have suction sides in fluid communication with the multi-dose compartments 220(1),220(2) for drawing up treatment agent therefrom, and delivery sides in fluid communication with the channels 215(1),215(2) for delivering the treatment agent thereto. Preferably, as herein assumed, the pump actuation part 225(1) is associated with the multi-dose compartment 220(1) and with the channel 215(1) (it meaning that the suction and delivery sides of the pump actuation part 225(1) are in fluid communication with the multi-dose compartment 220(1) and with the channel 215(1), respectively), and the pump actuation part 225(2) is associated with the multi-dose compartment 220(2) and with the channel 215(2) (it meaning that the suction and delivery sides of the pump actuation part 225(2) are in fluid communication with the multi-dose compartment 220(2) and with the channel 215(2), respectively). According to an exemplary embodiment of the present invention, the suction sides and the delivery sides of the pump actuation part 225(1),225(2) comprise suction and delivery pipes in the form of deformable tubes, and each pump actuation part 225(1),225(2) preferably comprises a peristaltic rotor adapted to hydraulically cooperate with the respective deformable tubes for allowing the fluid (i.e., the treatment agent dose(s)) in the deformable tubes to move during the rotation of the peristaltic rotor.

As visible in the figures, the pump actuation parts 225(1), 225(2) are advantageously housed in a corresponding pump housing 228 on the rear portion of the drawer 115 (rear with respect to the drawer front along direction x).

Figure 2B:
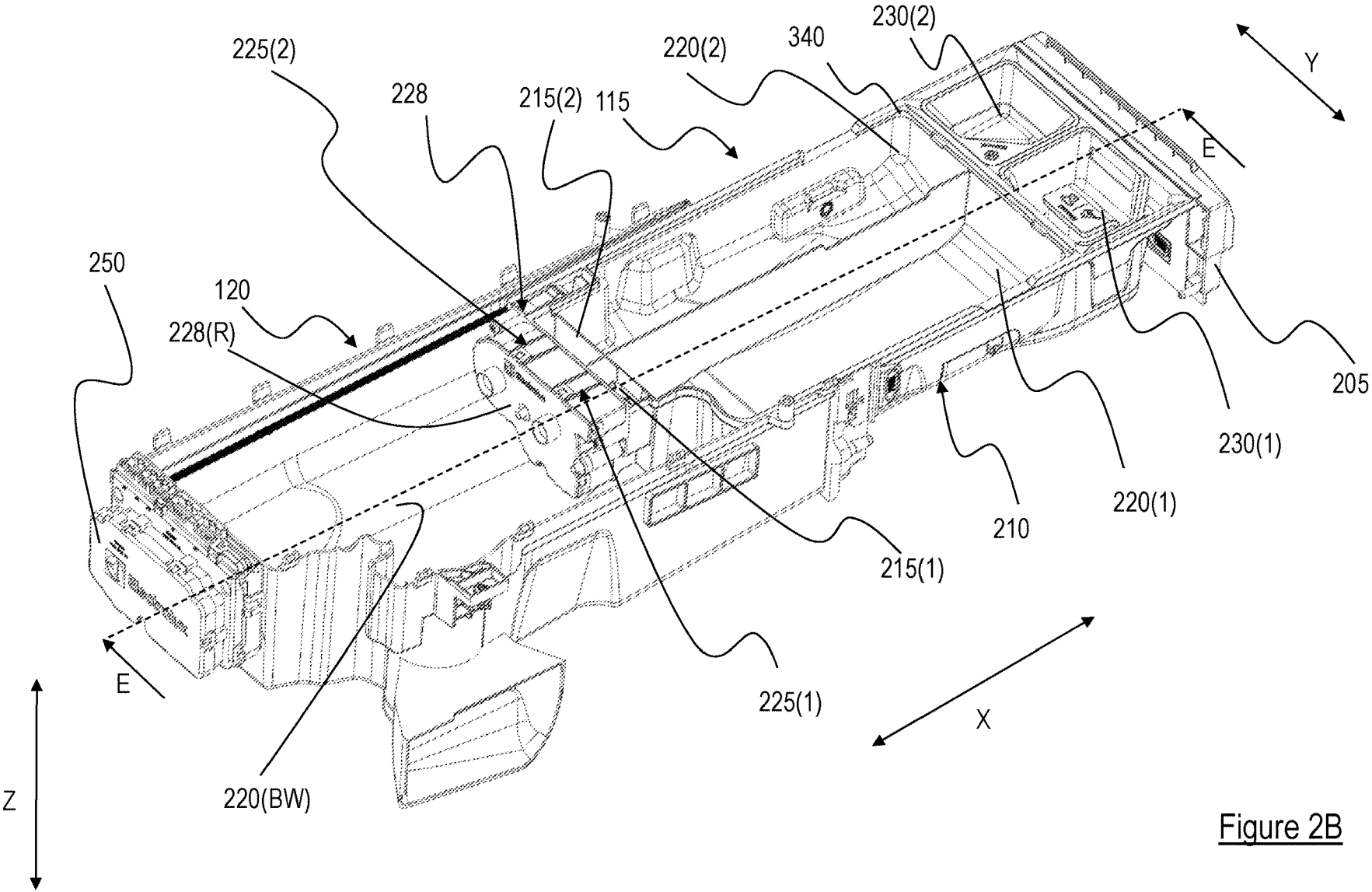
FIG. 2B shows a perspective view of the drawer of FIG. 2A in an extracted position within a drawer seat, according to an embodiment of the present invention.

Preferably, when the drawer 115 is in the retracted position, the pump actuation parts 225(1),225(2) are adapted to mechanically couple with one or more electrically-operated pump driving parts preferably provided in the drawer seat 120 of the pumping system, such as for example housed in a motor shell 250 fixed on a rear portion of the drawer seat 120 (see FIG. 2B). Upon said mechanical coupling the electrically-operated pump driving parts allow driving of the pump actuation parts 225(1),225(2), such as rotating the peristaltic rotor thereof. The electrically-operated pump driving parts are selectively activated and controlled by the control unit 130 based on the treatment cycle selected through (and according to parameters thereof set through) the user interface 125.

The multi-dose compartments 220(1),220(2), the channels 215(1),215(2) and the pumping system (comprising in turn the pump actuation parts 225(1),225(2) and the pump driving parts housed in the motor shell 250) are part of an auto-dose treatment agent delivering device (hereinafter, simply referred to as "treatment agent delivering device") adapted to be enabled to implement an auto-dosing functionality in which, at each treatment cycle, a predetermined amount of treatment agent is automatically taken (by means of the pumping system) from one or both of the multi-dose compartments 220(1),220(2) and fed to the laundry treatment chamber (after being mixed with water in the mixing region of the drawer 115).

According to the preferred embodiment of the present invention herein considered and illustrated, the drawer 115 also comprises one or more (two, in the example at issue) drawer compartments 230(1), 230(2) each one adapted to contain an amount of a respective treatment agent sufficient for performing a single treatment cycle, hereinafter referred to as mono-dose compartments 230(1), 230(2). Just as an example, the mono-dose compartment 230(1) may be arranged to contain a powder or liquid washing detergent, whereas the mono-dose compartment 230(2) may be arranged to contain a powder or liquid or pearl softener. Each mono-dose compartment 230(1), 230(2) is provided with a top opening for the loading of treatment agent from above by a user.

Preferably, the mono-dose compartments 230(1),230(2) are, along direction x, between the handle 205 and the multi-dose compartments 220(1),220(2). More preferably, the mono-dose compartments 230(1),230(2) are formed in a region of the drawer body 210 that, when the drawer handle 205 is mounted on the drawer body 210, is proximal to the drawer handle 205 (hereinafter referred to as front region of the drawer body 210), whereas the multi-dose compartments 220(1),220(2) are formed in a region of the drawer body 210 (hereinafter referred to as rear region of the drawer body 210) that, along direction x, is rearward with respect to the front region of the drawer body 210.

When the treatment agent delivering device is enabled, the laundry appliance 100 is configured to operate according to the abovementioned auto-dosing functionality in which, at each treatment cycle, the treatment agent delivering device automatically takes an amount of treatment agent from the multi-dose compartments 220(1),220(2) and said amount is fed into the laundry treatment chamber; when the treatment agent delivering device is instead disabled, the laundry appliance 100 is configured to operate according to a manual-dosing functionality, in which the (whole) treatment agent (manually introduced by a user) in the at least one of the mono-dose compartments 230(1), 230(2) is fed into the laundry treatment chamber for being used during a single treatment cycle.

In other words, for a generic selected treatment cycle, a dose of treatment agent is fed into the laundry treatment chamber to be exploited for treating laundry located in the laundry treatment chamber according to phases of such selected treatment cycle. The amount of treatment agent of said dose is set in an automatic way by the treatment agent delivering device when the latter is enabled (auto-dosing functionality), or the amount of treatment agent of said dose is set by the user in a manual way to the amount of treatment agent the user actually put inside at least one of the mono-dose compartments 230(1), 230(2) when the treatment agent delivering device is disabled (manual-dosing functionality).

Figure 3:
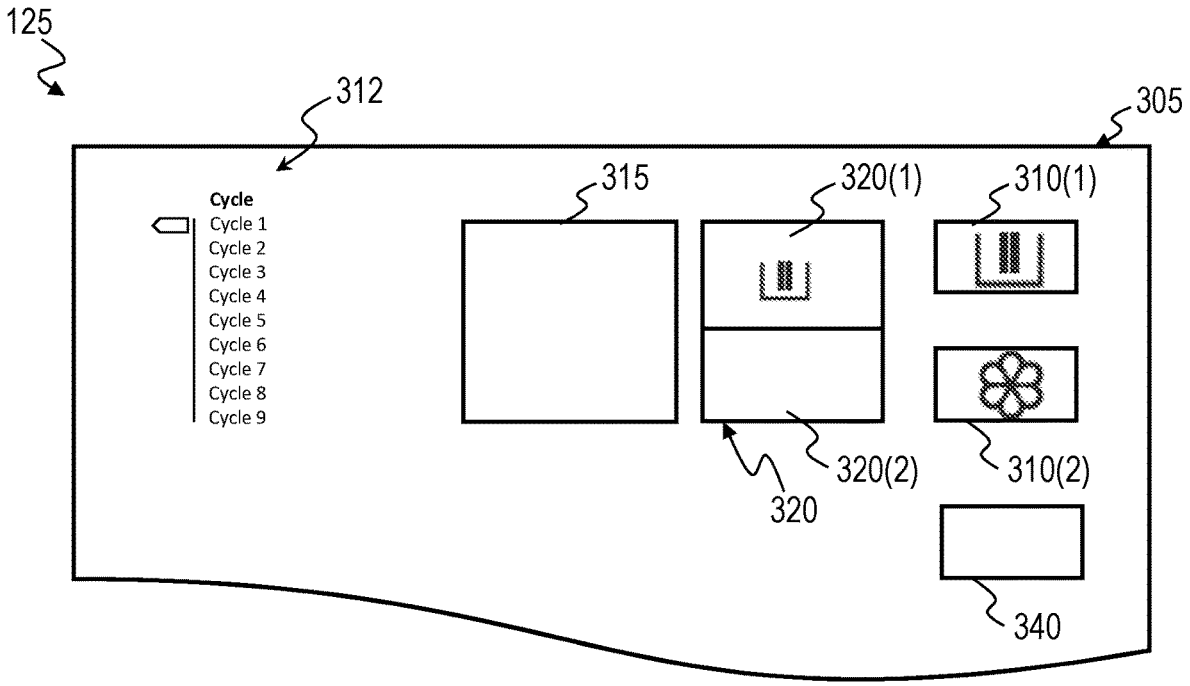
FIG. 3 shows portions of an user interface of the laundry appliance according to an embodiment of the present invention.

FIG. 3 shows portions of the user interface 125 according to an embodiment of the present invention.

Preferably, although not necessarily, the user interface 125 comprises a display unit 305 for visually displaying one or more pieces of information; the display unit 305 may for example comprise a light emitting polymer display (LPD), a liquid crystal display, a thin film transistor-liquid crystal display, or an organic light-emitting diode display. In the preferred, not limiting, embodiment herein considered, the display unit 305 comprises a touch sensitive display unit to allow user selection of laundry appliance features by touching activated regions of the display unit 305.

The user interface 125 preferably comprises one or more input selectors for allowing the user to select the auto-dosing or manual dosing functionality, to select a treatment cycle and to control one or more parameters of the selected treatment cycle (including, but not limited to, temperature, weight of laundry, laundry load dirt level, spin speed, start time delay).

In the exemplary embodiment of the invention herein described, the input selectors comprise two input selectors 310(1), 310(2) each one preferably associated with a respective multi-dose compartment 220(1), 220(2). Moreover, in the exemplary embodiment of the invention herein described, the input selectors 310(1), 310(2) are virtual selectors (i.e., whose activation/deactivation is associated with touch-sensitive electric components). However, similar considerations apply in case the input selectors 310(1), 310(2) are physical selectors (i.e., whose activation/deactivation is associated with displacements of mechanical components).

According to an embodiment of the present invention, the treatment agent delivering device may be enabled (thus enabling the auto-dosing functionality) through interaction with one or both the input selectors 310(1), 310(2).

For example, according to an embodiment of the present invention, if the input selector 310(1) is touched—or pressed—, a first auto-dosing enable command is sent to the control unit 130. In response to said first auto-dosing enable command, the control unit 130 enables the treatment agent delivering device and causes the laundry appliance 100 to switch to a first auto-dosing functionality in which the multi-dose compartment 220(1) is exploited. According to this functionality mode, when a selected treatment cycle is selected, the control unit 130 drives the treatment agent delivering device to automatically take an amount of treatment agent from the multi-dose compartment 220(1) and fed this amount into the laundry treatment chamber during a corresponding phase of the selected treatment cycle. By touching—or pressing—again the input selector 310(1), the treatment agent delivering device is disabled.

Similarly, if the input selector 310(2) is touched—or pressed—, a second auto-dosing enable command is preferably sent to the control unit 130. In response to said second auto-dosing enable command, the control unit 130 enables the treatment agent delivering device and causes the laundry appliance 100 to switch to a second auto-dosing functionality in which the multi-dose compartment 220(2) is exploited. According to this functionality mode, when a selected treatment cycle is selected, the control unit 130 drives the treatment agent delivering device to automatically take an amount of treatment agent from the multi-dose compartment 220(2) and fed this amount into the laundry treatment chamber during a corresponding phase of the selected treatment cycle. By touching—or pressing—again the input selector 310(2), the treatment agent delivering device is disabled.

According to an embodiment of the present invention, the treatment agent delivering device is enabled also when both the input selectors 310(1) and 310(2) are touched (or pressed) in sequence or at the same time. In this case, a third auto-dosing enable command is sent to the control unit 130. In response to said third auto-dosing enable command, the control unit 130 enables the treatment agent delivering device and causes the laundry appliance 100 to switch to a third auto-dosing functionality in which both the multi-dose compartment 220(1) and the multi-dose compartment 220(2) are exploited. According to this functionality mode, when a selected treatment cycle is selected, the control unit 130 drives the treatment agent delivering device to automatically take an amount of a first treatment agent (e.g., a washing detergent) from the multi-dose compartment 220(1) and fed this amount into the laundry treatment chamber during a corresponding phase of the selected treatment cycle, and to automatically take an amount of a second treatment agent (e.g., a liquid softener) from the multi-dose compartment 220(2) and fed this amount into the laundry treatment chamber during the same or during a further phase of the selected treatment cycle.

In other words, according to an embodiment of the present invention, through interaction with the input selectors 310(1), 310(2) it is possible to switch the operation of the laundry appliance 100 among:

- a manual-dosing functionality, in which the treatment agent delivering device is disabled;
- a first auto-dosing functionality, in which the treatment agent delivering device is enabled and the treatment agent contained in the multi-dose compartment 220(1) is used;
- a second auto-dosing functionality, in which the treatment agent delivering device is enabled and the treatment agent contained in the multi-dose compartment 220(2) is used;
- a third auto-dosing functionality, in which the treatment agent delivering device is enabled and the treatment agent contained in the multi-dose compartment 220(1) and the treatment agent contained in the multi-dose compartment 220(2) are used;

Naturally, the concepts of the present invention can be applied in case the selection of the manual/auto-dosing functionalities is carried out in a different way, such as for example with a single physical or virtual selector, or with one or more physical or virtual cursors, sliders or knob.

Furthermore, similar considerations may be applied in case both the two multi-dose compartments 220(1), 220(2) contain the same treatment agent (e.g., a washing detergent). For example, in this case the third auto-dosing functionality may provide for feeding amounts of the treatment agents contained in the two multi-dose compartments 220(1), 220(2) in a same phase of the selected treatment cycle, e.g., at the same time or sequentially.

Moreover, according to another embodiment of the present invention, in which only one multi-dose compartment is provided, only one kind of auto-dosing functionality is possible, in which the treatment agent contained in the only one multi-dose compartment is used.

Although not shown, additional physical or virtual input selectors may be provided, such as for setting one or more parameters of the selected treatment cycle, such as temperature, spin speed, amount of laundry load.

As exemplary illustrated, the display unit 305 comprises a cycle section 312, i.e. a section where a number of selectable treatment cycles are listed. The treatment cycles may be presented or listed with a graphic layout comprising textual indications (and/or symbols) associated with the selectable treatment cycles. The textual indications (and/or associated symbols) are preferably vertically superimposed one to the other in order to form a column of textual indications (and/or associated symbols). In the example illustrated, the treatment cycles are presented as a number of textual indications generically named "cycle 1", "cycle 2", "cycle 3", "cycle 4", "cycle 5", "cycle 6", "cycle 7", "cycle 8", "cycle 9", and may for example be conventional treatment cycles including, but not limited to, "Cottons", "Cotton ECO" "Synthetics", "Delicates", "Wool/Handwash". The treatment cycles may for example be selected through the above mentioned rotary knob, whose rotation advantageously causes a cursor or other pointer or slider to move vertically across the list of treatment cycle to visually indicate to the user the currently selected treatment cycle (however, embodiments of the present invention may be envisaged in which no rotary knob is provided and the cursor is an input selector in the form of a touch sensitive cursor moveable by user touch to select the treatment cycle).

As exemplary illustrated, the display unit 305 advantageously comprises a display region 315 for displaying the operative condition of the laundry appliance through status information such as information about a status of one or more components of the laundry appliances 100 and/or information about a status of the treatment cycle. Examples of said information status may comprise information about a residual time to the end of the ongoing treatment cycle, and/or information about a current phase of the ongoing treatment cycle, and/or selected parameters for the ongoing treatment cycle.

Preferably, as illustrated, the display unit 305 further comprises a display region (or more thereof) 320 for displaying a graphical indication of a (e.g., enabled or disabled) status of the treatment agent delivering device, and therefore showing if an auto-dosing functionality or the mono-dose functionality is enabled. More preferably, the display region 320 comprises a (e.g., upper) display region 320(1) associated with the multi-dose compartment 220(1) and a (e.g., lower) display region 320(2) associated with the multi-dose compartment 210(2). For example, according to an exemplary embodiment of the present invention, when the manual-dosing functionality is enabled, no graphical indication is shown in the display regions 320(1), 320(2). If the first auto-dosing functionality is enabled, a graphical indication is shown in the display region 320(1). If the second auto-dosing functionality is enabled, a graphical indication is shown in the display region 320(2). If the third auto-dosing functionality is enabled, a first graphical indication is preferably shown in the display region 320(1) and at the same time a second graphical indication is shown in in the display region 320(2).

In the illustrated example, in which the multi-dose compartment 220(1) is configured to contain washing detergent and the multi-dose compartment 220(2) is configured to contain liquid softener, said graphical indications which can be displayed comprise a washing detergent symbol adapted to be displayed in the display region 320(1), and a softener symbol adapted to be displayed in the display region 320(2). The example illustrated in FIG. 3 corresponds to the case in which the first auto-dosing functionality is enabled.

Naturally, similar considerations apply in case the display regions 320(1), 320(2) are replaced by a single display region capable of displaying a graphical indication indicative of the enabled functionality, for example capable of displaying both the abovementioned washing detergent symbol and the softener symbol.

According to an embodiment of the present invention, the user interface 125 further comprises a (virtual or physical) input selector 340 that, once touched—or pressed—an intensive treatment mode command is sent to the control unit 130. In response to said intensive treatment mode command, the control unit 130 enables an intensive treatment mode, causing the laundry appliance 100 to perform further phases in addition to the phases of the selected treatment cycle in order to improve the laundry treatment efficiency, such as for example when the laundry located in the laundry treatment chamber is particularly dirt.

Naturally, similar considerations apply in case the input selector 340 is implemented in a different way, such as for example in the form of a virtual or physical cursor or slider.

According to an embodiment of the present invention, all or some of the input selectors and/or the display regions of the user interface 125 may be also available on the user device UD, so that an user of the user device UD is provided with the possibility of controlling the laundry appliance 100 operation in a remote way.

According to an embodiment of the present invention, the intensive treatment mode command may be automatically sent to the control unit 130 by a sensor device (e.g., an optical sensor device) capable of sensing a dirt degree of the laundry when the sensed dirt degree is above a predetermined threshold.

Figure 4A:
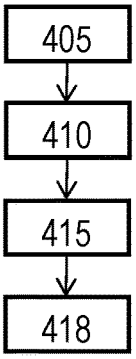
FIG. 4A is a flow chart showing operations carried out by a control unit of the laundry appliance when a treatment agent delivering device is disabled, and an intensive treatment mode is disabled.
Figure 4B:
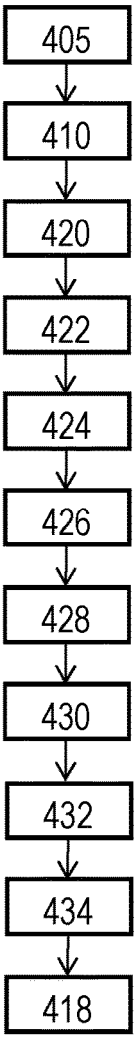
FIG. 4B is a flow chart showing operations carried out by the control unit when the treatment agent delivering device is disabled, and the intensive treatment mode is enabled.
Figure 4C:
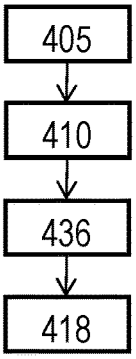
FIG. 4C is a flow chart showing operations carried out by the control unit when the treatment agent delivering device is enabled, and the intensive treatment mode is disabled.
Figure 4D:
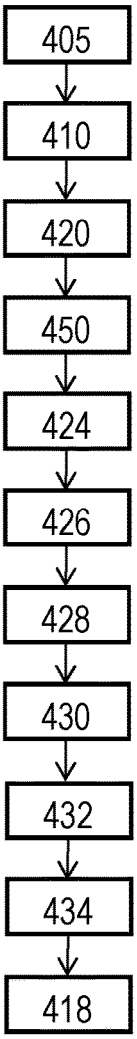
FIG. 4D is a flow chart showing operations carried out by the control unit when the treatment agent delivering device is enabled, and the intensive treatment mode is enabled.

In order to describe how the laundry appliance 100 may operate according to embodiments of the present invention, reference will be now made to FIGS. 4A-4D. wherein FIG. 4A is a flow chart showing operations carried out by the control unit 130 when the treatment agent delivering device is disabled, and the intensive treatment mode is disabled, FIG. 4B is a flow chart showing operations carried out by the control unit 130 when the treatment agent delivering device is disabled, and the intensive treatment mode is enabled, FIG. 4C is a flow chart showing operations carried out by the control unit 130 when the treatment agent delivering device is enabled, and the intensive treatment mode is disabled, and FIG. 4D is a flow chart showing operations carried out by the control unit 130 when the treatment agent delivering device is enabled, and the intensive treatment mode is enabled.

In the situation corresponding to FIG. 4A, the laundry appliance is operating according to the manual-dosing functionality (i.e., the treatment agent delivering device is disabled) and the intensive treatment mode is disabled. In this case, instead of using the treatment agent stored in the multi-dosing compartments 220(1), 220(2), the laundry located in the laundry treatment chamber will be preferably treated by exploiting the treatment agent the user manually put inside one of the mono-dose compartments, such as for example the mono-dose compartment 230(1).

The first phase provides for the control unit 130 that selects a specific treatment cycle among the various available predetermined treatment cycles (block 405) preferably in response to an input command sent by the user, for example through the cycle section 312 of the user interface 125 or through the user device UD. As already mentioned above, together with the input command used for the selection of the treatment cycle, the user may also set one or more parameters of the selected treatment cycle, such as for example water temperature and spin speed, through proper input selectors.

In the next phase, the control unit 130 preferably calculates an estimate of the weight of the laundry located in the laundry treatment chamber (block 410). This phase is an optional phase, which in some embodiments of the present invention may be skipped. For example, the laundry weight estimation can be calculated by taking into account an automatic weight estimation carried out by proper weight sensors (not illustrated) or by taking into account a manual weight indication directly inputted by the user through the user interface 125 or the user device UD.

In the next phase, the control unit 130 controls the feeding of a dose of treatment agent together with an amount of water inside the laundry treatment chamber (block 415). In this case, the dose of treatment agent actually fed in the laundry treatment chamber is the amount of treatment agent contained in a selected one of the mono-dose compartments 230(1), 230(2), such as for example the mono-dose compartment 230(1), which was manually filled in advance by the user.

According to an embodiment of the present invention, the amount of water fed in the laundry treatment chamber is automatically calculated/set by the control unit 130, for example according to the estimate of the laundry weight previously calculated, and optionally modified based on the selected treatment cycle and/or based on parameters thereof inputted by the user. According to another embodiment of the present invention, the amount of water fed in the laundry treatment chamber may instead be independent from the weight of the laundry or may be a consequence of the actual load of laundry in the laundry treatment chamber (adsorbency-dependence).

Then, the control unit 130 drives the laundry appliance 100 to carry out the remaining set of phases of the selected treatment cycle (block 418). This set of phases depends on the specific treatment cycle which has been selected, and for example usually comprises, in addition to the already performed water and treatment agent dose feeding phase (block 415), at least a treatment phase in which laundry located in the laundry treatment chamber together with the water and the dose of treatment agent previously fed is treated by means of tumbling obtained through drum rotation. As it is well known to those skilled in the art, other phases may comprise, among the others, heating of the water at proper temperatures, rinsing and/or spinning of the laundry.

In the situation corresponding to FIG. 4B, the laundry appliance is operating according to the manual-dosing functionality, with the treatment agent delivering device that is disabled. Therefore, like in the situation described in FIG. 4A, instead of using the treatment agent stored in the multi-dosing compartments 220(1), 220(2), the laundry located in the laundry treatment chamber will be treated by exploiting the treatment agent the user manually put inside one of the mono-dose compartments, such as for example the mono-dose compartment 230(1). Unlike the situation of FIG. 4A, in the case corresponding to FIG. 4B the intensive treatment mode is enabled (for example by the user through the input selector 340 of the user interface 125) to cause the laundry appliance 100 to perform further phases in addition to the ones of the selected treatment cycle. On this regard, phases to be described with reference to FIG. 4B which have been already described with reference to FIG. 4A will be identified with the same numeric reference.

The first phase provides for the control unit 130 that selects a specific treatment cycle among the various available predetermined treatment cycles (block 405) preferably in response to an input command sent by the user, in the same way as already described with reference to FIG. 4A.

In the next phase, the control unit 130 preferably calculates an estimate of the weight of the laundry located in the laundry treatment chamber (block 410) in the same way as already described with reference to FIG. 4A.

The following phase preferably provides for the control unit 130 that drives the feeding of a fixed amount of water (e.g., 1 liter) in the laundry treatment chamber (block 420). During this phase, the drum is preferably kept stationary, and the laundry located in the laundry treatment chamber is not tumbled.

Then, the control unit 130 preferably controls the feeding of a dose of treatment agent inside the laundry treatment chamber (block 422). Like in the case described with reference to FIG. 4A, the dose of treatment agent actually fed in the laundry treatment chamber is the amount of treatment agent contained in a selected one of the mono-dose compartments 230(1), 230(2), such as for example the mono-dose compartment 230(1), which was manually filled in advance by the user.

The next phase (block 424) preferably provides for the control unit 130 that drives the feeding of a further fixed amount of water (e.g., 7 liters) in the laundry treatment chamber. During this phase, the drum is preferably driven in rotation by the control unit 130 to tumble the laundry located in the laundry treatment chamber.

In other words, when the intensive treatment mode is enabled, the subset of phases 420, 422 and 424 carried out before the complete water loading is carried out (at block 426), cause the laundry to be subjected to pre-wash operations.

At this point, the control unit 130 controls the feeding of a further amount of water inside the laundry treatment chamber (block 426); such further amount of water is preferably calculated by the control unit 130 in such a way that the whole amount of water actually fed into the laundry treatment chamber (i.e., taking into account also the two fixed amounts of water already fed at blocks 420 and 424) is calibrated according to the estimate of the laundry weight previously calculated, and optionally modified based on the selected treatment cycle and/or based on parameters thereof inputted by the user. However, according to another embodiment of the present invention, the amount of water fed in the laundry treatment chamber in this phase at well may instead be independent from the weight of the laundry or based on the actual load of laundry in the laundry treatment chamber (adsorbency-dependence).

In the next phase (block 428), the control unit 130 preferably causes the water located in the laundry treatment chamber to be heated until reaching a predetermined temperature (e.g., 42° C.).

During the following phase (block 430), the drum is preferably driven in rotation by the control unit 130 to tumble the laundry located in the laundry treatment chamber for a corresponding time period (for example, for 3 minutes).

Optionally, the control unit 130 may cause a further treatment agent, such as laundry bleach, which was manually put in advance by the user inside one of the mono-dose compartments (such as for example the mono-dose compartment 230(2)) to be fed in the laundry treatment chamber (block 432).

Then (block 434), the drum is preferably driven in rotation by the control unit 130 to tumble the laundry located in the laundry treatment chamber for another corresponding time period (for example, for 5 minutes).

In other words, when the intensive treatment mode is enabled, the subset of phases 428, 430, 432 and 434 carried out after the water loading is carried out (at block 426), promote the activation of the dose of treatment agent (optionally together with the further treatment agent) through agitation and increase of temperature.

Then, the control unit 130 drives the laundry appliance 100 to carry out the remaining set of phases of the selected treatment cycle (block 418). As already described with reference to FIG. 4A, this set of phases depends on the specific treatment cycle which has been selected, and usually comprises at least a treatment phase in which laundry located in the laundry treatment chamber together with the water and the dose of treatment agent previously fed is treated by means of tumbling obtained through drum rotation, while other phases may comprise, among the others, heating of the water at proper temperatures, rinsing and/or spinning of the laundry.

In the situation corresponding to FIG. 4C, the laundry appliance is operating according the first auto-dosing functionality, i.e., with the treatment agent delivering device that is enabled, and the laundry located in the laundry treatment chamber that will be treated by exploiting a dose automatically taken from the multi-dosing compartment 220(1). Naturally, similar considerations apply in case the laundry appliance is operating according to the second or third auto-dosing functionality, i.e., with the laundry located in the laundry treatment chamber that will be treated by exploiting a dose automatically taken from the multi-dosing compartment 220(2) or from both the multi-dosing compartments 220(1), 220(2). Moreover, in the situation corresponding to FIG. 4C the intensive treatment mode is disabled. On this regard, phases to be described with reference to FIG. 4C which have been already described with reference to FIG. 4A will be identified with the same numeric reference.

The first phase provides for the control unit 130 that selects a specific treatment cycle among the various available predetermined treatment cycles (block 405) preferably in response to an input command sent by the user, in the same way as already described with reference to FIG. 4A.

In the next phase, the control unit 130 preferably calculates an estimate of the weight of the laundry located in the laundry treatment chamber (block 410) in the same way as already described with reference to FIG. 4A.

In the next phase, the control unit 130 controls the feeding of a dose of treatment agent together with an amount of water inside the laundry treatment chamber (block 436). Unlike the cases described in FIGS. 4A and 4B, the treatment agent delivering device is instead enabled. In this case, the control unit 130 firstly automatically calculates the dose of treatment agent to be fed in the laundry treatment chamber, and then drives the pumping system of the treatment agent delivering device to automatically take said dose from at least one multi-dose compartment (e.g., from the multi-dose compartment 220(1) in case of first auto-dosing functionality) and deliver it into the laundry treatment chamber (after being mixed with water).

According to an embodiment of the present invention, the dose of treatment agent calculated by the control unit 130 comprises a first amount of treatment agent calculated based on an operative condition of the laundry appliance. For example, said first amount can be calculated based on the selected treatment cycle, and/or based on an indication/estimation/measure of the weight of the laundry located inside the laundry treatment chamber, and/or based on a dirt degree of the laundry located inside the laundry treatment chamber (for example directly inputted by the user through the user interface 125 or automatically estimated/measured through proper, e.g., optical, sensors). Moreover, according to an embodiment of the present invention, the calculation of the first amount of treatment agent can be also carried out starting from a predetermined base amount of treatment agent, e.g., which can be set by the user through the user interface 125 or can be already set by the control unit 130.

As in the case corresponding to FIG. 4A, the amount of water fed in the laundry treatment chamber is preferably automatically calculated by the control unit 130 according to the estimate of the laundry weight previously calculated, and optionally modified based on the selected treatment cycle and/or based on parameters thereof inputted by the user. According to another embodiment of the present invention, the amount of water fed in the laundry treatment chamber may instead be independent from the weight of the laundry or may be based on the actual load of laundry in the laundry treatment chamber (adsorbency-dependence).

Then, as in the case corresponding to FIG. 4A, the control unit 130 drives the laundry appliance 100 to carry out the remaining set of phases of the selected treatment cycle (block 418). This set of phases depends on the specific treatment cycle which has been selected, and usually comprises, in addition to the already performed water and treatment agent dose feeding phase (block 415), at least a treatment phase in which laundry located in the laundry treatment chamber together with the water and the dose of treatment agent previously fed is treated by means of tumbling obtained through drum rotation. As it is well known to those skilled in the art, other phases may comprise, among the others, heating of the water at proper temperatures, rinsing and/or spinning of the laundry.

In the situation corresponding to FIG. 4D, the laundry appliance is operating according the first auto-dosing functionality, i.e., with the treatment agent delivering device that is enabled, and the laundry located in the laundry treatment chamber that will be treated by exploiting a dose automatically taken from the multi-dosing compartment 220(1). As already mentioned before, similar considerations apply in case the laundry appliance is operating according to the second or third auto-dosing functionality, i.e., with the laundry located in the laundry treatment chamber that will be treated by exploiting a dose automatically taken from the multi-dosing compartment 220(2) or from both the multi-dosing compartments 220(1), 220(2). Moreover, unlike the case corresponding to FIG. 4C, in the situation corresponding to FIG. 4D the intensive treatment mode is enabled (for example by the user through the input selector 340 of the user interface 125) to cause the laundry appliance 100 to perform further phases in addition to the ones of the selected treatment cycle. On this regard, phases to be described with reference to FIG. 4D which have been already described with reference to FIG. 4A or 4B will be identified with the same numeric references.

The first phase provides for the control unit 130 that selects a specific treatment cycle among the various available predetermined treatment cycles (block 405) preferably in response to an input command sent by the user, in the same way as already described with reference to FIG. 4A.

In the next phase, the control unit 130 preferably calculates an estimate of the weight of the laundry located in the laundry treatment chamber (block 410) in the same way as already described with reference to FIG. 4A.

In the same way as already described with reference to FIG. 4B, the following phase preferably provides for the control unit 130 that drives the feeding of a fixed amount of water (e.g., 1 liter) in the laundry treatment chamber (block 420). During this phase, the drum is preferably kept stationary, and the laundry located in the laundry treatment chamber is not tumbled.

In the next phase, the control unit 130 controls the feeding of a dose of treatment agent (block 450). As in the case corresponding to FIG. 4C, the treatment agent delivering device is enabled. In this case, the control unit 130 firstly automatically calculates the dose of treatment agent to be fed in the laundry treatment chamber, and then drives the pumping system of the treatment agent delivering device to automatically take said dose from at least one multi-dose compartment (e.g., from the multi-dose compartment 220(1) in case of first auto-dosing functionality) and deliver it into the laundry treatment chamber (after being mixed with water).

As already described by making reference to FIG. 4C, the dose of treatment agent calculated by the control unit 130 comprises a first amount of treatment agent calculated based on an operative condition of the laundry appliance 100. For example, said first amount can be calculated based on the selected treatment cycle, and/or based on an indication/estimation of the weight of the laundry located inside the laundry treatment chamber, and/or based on a dirt degree of the laundry located inside the laundry treatment chamber, and/or starting from a predetermined base amount of treatment agent.

According to an embodiment of the present invention, when the treatment agent delivering device is enabled, and at the same time the intensive treatment mode is enabled, in order to calculate the dose of treatment agent to be delivered into the laundry treatment chamber, the control unit 130 automatically adds a second amount of treatment agent to the calculated first amount of treatment agent. In other words, according to an embodiment of the present invention, when the treatment agent delivering device is enabled, the intensive treatment mode not only causes the laundry appliance 100 to perform further phases in addition to the ones of the selected treatment cycle, but also automatically causes an increase of the amount of treatment agent contained in the dose of treatment agent which will be fed in the laundry treatment chamber.

Therefore, unlike the known solutions, the activation of the intensive treatment mode according to the embodiments of the present invention allows to fully exploit the advantageous features offered by a laundry appliance capable of operating with an auto-dosing functionality. When a user activated the intensive treatment mode because the laundry to be treated is particular dirty, if the auto-dosing-functionality is enabled, she/he does not have to manually add an additional dose of treatment agent, because the dose of treatment agent fed by the treatment agent delivering device is automatically increased. In other words, according to the embodiments of the present invention, instead of having a dedicated input selector for increasing the dose of treatment agent to be fed in the laundry treatment chamber when the laundry to be treated is particular dirty, this input selector is the same used to enable the intensive treatment mode. In this way, the interaction between the user and the user interface 125 is advantageously simplified, since the treatment agent dose increasing is automatically managed by the control unit 130.

According to an embodiment of the present invention, the control unit 130 is configured to calculate said second amount of treatment agent (to be added to said calculated first amount) for setting it to a value based on the calculated first amount.

For example, according to an embodiment of the present invention, the control unit 130 is configured to set said second amount of treatment agent to a value corresponding to a percentage, preferably between 5% and 40%, and more preferably between 15% and 25%, of the calculated first amount of treatment agent.

The next phase (block 424) provides for the control unit 130 that preferably drives the feeding of a further fixed amount of water (e.g., 7 liters) in the laundry treatment chamber. During this phase, the drum is preferably driven in rotation by the control unit 130 to tumble the laundry located in the laundry treatment chamber.

As already mentioned with reference to FIG. 4B, when the intensive treatment mode is enabled, the subset of phases 420, 450 and 424 carried out before the complete water loading is carried out (at block 426), cause the laundry to be subjected to pre-wash operations. However, compared to the case corresponding to FIG. 4B, in this case the dose of treatment agent comprises a greater amount of treatment agent (i.e., greater than the first amount calculated based on the operative condition of the laundry appliance 100).

At this point, the control unit 130 controls the feeding of a further amount of water inside the laundry treatment chamber (block 426); such further amount of water is calculated by the control unit 130 in such a way that the whole amount of water actually fed into the laundry treatment chamber (i.e., taking into account also the two fixed amounts of water already fed at blocks 420 and 424) is preferably calibrated according to the estimate of the laundry weight previously calculated, and optionally modified based on the selected treatment cycle and/or based on parameters thereof inputted by the user. However, according to another embodiment of the present invention, the amount of water fed in the laundry treatment chamber in this phase at well may instead be independent from the weight of the laundry or may be based on the actual load of laundry in the laundry treatment (adsorbency-dependent).

In the next phase (block 428), the control unit 130 causes the water located in the laundry treatment chamber to be preferably heated until reaching a predetermined temperature (e.g., 42° C.). During the following phase (block 430), the drum is preferably driven in rotation by the control unit 130 to tumble the laundry located in the laundry treatment chamber for a corresponding time period (for example, for 3 minutes).

Optionally, the control unit 130 may cause a further treatment agent, such as laundry bleach, which was manually put in advance by the user inside one of the mono-dose compartments (such as for example the mono-dose compartment 230(2)) to be fed in the laundry treatment chamber (block 432).

Then (block 434), the drum is preferably driven in rotation by the control unit 130 to tumble the laundry located in the laundry treatment chamber for another corresponding time period (for example, for 5 minutes).

As already mentioned with reference to FIG. 4B, when the intensive treatment mode is enabled, the subset of phases 428, 430, 432 and 434 carried out after the water loading is carried out (at block 426), promote the activation of the dose of treatment agent (optionally together with the further treatment agent) through agitation and increase of temperature. However, compared to the case corresponding to FIG. 4B, in this case the dose of treatment agent comprises a greater amount of treatment agent (i.e., greater than the first amount calculated based on the operative condition of the laundry appliance 100).

Then, the control unit 130 drives the laundry appliance 100 to carry out the remaining set of phases of the selected treatment cycle (block 418). As already described with reference to FIG. 4A, this set of phases depends on the specific treatment cycle which has been selected, and usually comprises at least a treatment phase in which laundry located in the laundry treatment chamber together with the water and the dose (in this case comprising both the calculated first and second amounts) of treatment agent previously fed is treated by means of tumbling. Other phases may comprise, among the others, heating of the water at proper temperatures, rinsing and/or spinning of the laundry.

Although in the present description reference has been made to a laundry appliance comprising (in addition to the multi-dose compartments 220(1), 220(2)) also mono-dose compartments 230(1), 230(2) each one adapted to contain an amount of a respective treatment agent sufficient for performing a single treatment agent, the concept of the present invention can be directly applied to laundry appliances without mono-dose compartments and therefore capable of operating according to the auto-dosing functionality only. In this case, according to an embodiment of the present invention, the treatment agent dose may be increased by the second amount every time the intensive treatment mode is enabled (the auto-dosing functionality being always enabled).

The concepts of the present invention can be also advantageously applied to laundry appliances which, in addition to a discharge system adapted to selectively drain liquid (e.g., water, or water mixed with treatment agent, such as detergent and/or laundry bleach and/or softener) from the laundry treatment chamber, are also equipped with a recirculation system which, during some phases of the selected treatment cycle (such as for example during water load phases, and/or during the treatment phases, and/or during the rinsing phases) takes some liquid from the bottom of the laundry treatment chamber, and reintroduces this liquid into the laundry treatment chamber, so as to deliver the liquid to the laundry from more than one directions. As it is known to those skilled in the art, this allows a better wetting of the laundry, and permits to use a smaller amount of water for performing the abovementioned phases of the treatment cycle.

Figure 5:
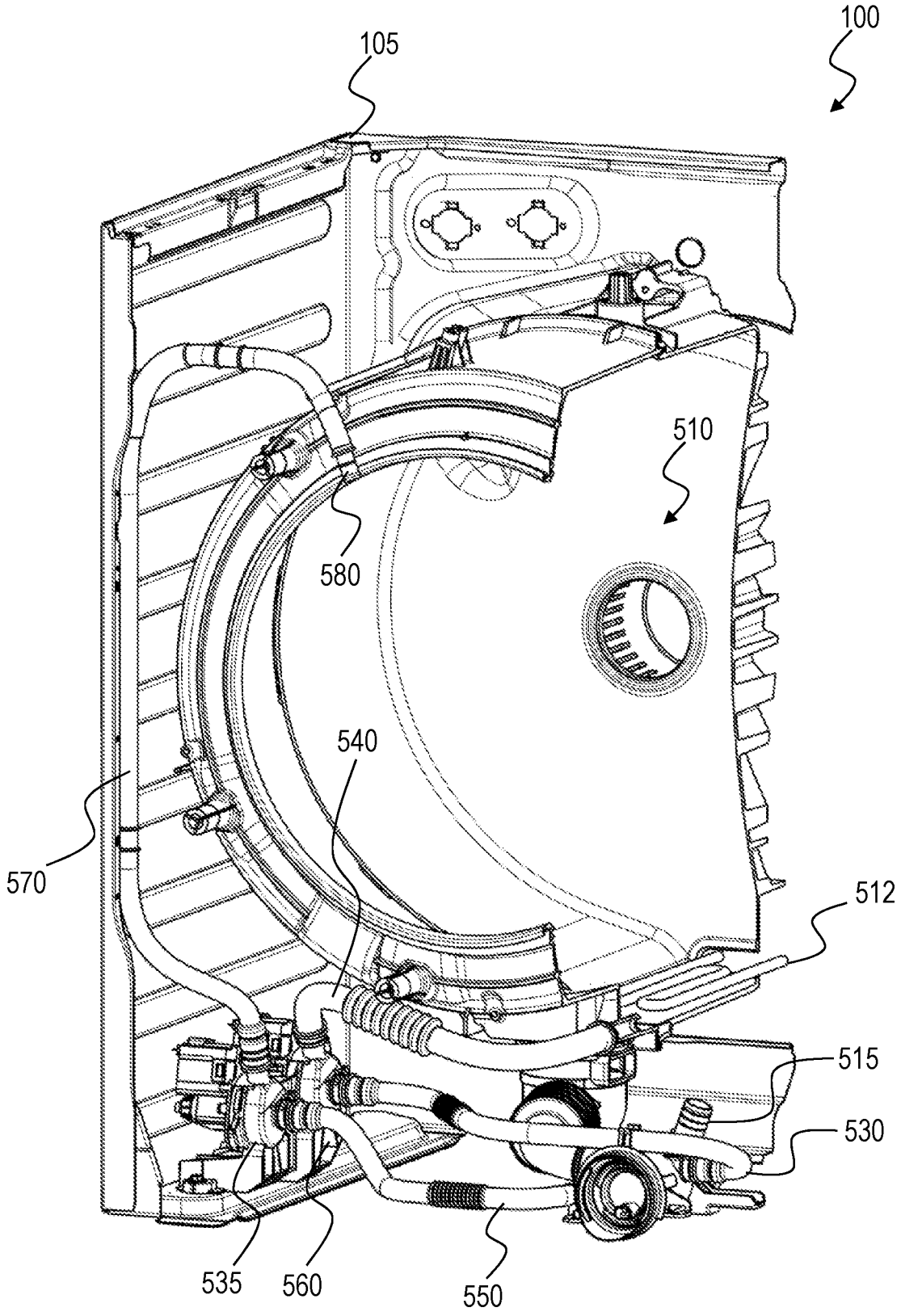
FIG. 5 is a partially sectioned view of an exemplary laundry appliance equipped with a recirculation system in addition to the drain system.

FIG. 5 is a partially sectioned view of an exemplary laundry appliance 100 equipped with a recirculation system (in addition to a drain system).

In the exemplary laundry appliance 100 illustrated in FIG. 5, the laundry treatment chamber is visible and is identified with reference 510. A heating resistor 512 is provided at the bottom of the laundry treatment chamber 510, adapted to be activated by the control unit 130 for heating water mixed with treatment agent in certain phases of the treatment cycles. Reference 515 identifies a discharge duct of the drain system adapted to receive liquid from the laundry treatment chamber 510. The discharge duct 515 is fluidly coupled with the laundry treatment chamber 510 through a discharge hole provided at the bottom of the laundry treatment chamber 510. A drain pump (not visible in figure but preferably connected upstream the discharge duct) is operable to cause the liquid located into the discharge duct to be discharged through a drain duct adapted to be connected to the water network system.

The exemplary laundry appliance 100 illustrated in FIG. 5 is equipped with a recirculation system comprising two recirculation circuits (however, the concepts of the present invention can be directly applied to cases in which a single recirculation circuit only is provided).

The first recirculation circuit (also referred to as "mixing circuit") comprises a first ("mixing") input recirculation duct 530 fluidly coupled with the laundry treatment chamber 510 through the discharge hole provided at the bottom of the laundry treatment chamber 510 and connected to a first ("mixing") recirculation pump 560 operable to cause the liquid located in the first input recirculation duct 530 to be conveyed to a first ("mixing") output recirculation duct 540 which is fluidly coupled with the bottom portion of the laundry treatment chamber 510 where the heating resistor 512 is located. When the first recirculation pump 560 is activated, liquid located in the bottom portion of the laundry treatment chamber 510 is drawn up and then reintroduced again at the bottom portion of the laundry treatment chamber 510 where the heating resistor 512 is located. This allows water to be efficiently mixed with treatment agent(s) because the liquid is recirculated (in the same portion of the laundry treatment chamber 510 from which it has been drawn up by the first recirculation pump 560) without touching the drum (and therefore before the liquid contacts the laundry located in the laundry treatment chamber). Moreover, in this way water is efficiently mixed with treatment agent(s) in a portion of the laundry treatment chamber 510 having high temperatures (being around the heating resistor 512), increasing thus the laundry treatment efficiency.

The second recirculation circuit (also referred to as "soaking circuit") comprises a second ("soaking") input recirculation duct 550 fluidly coupled with the laundry treatment chamber 510 through the discharge hole provided at the bottom of the laundry treatment chamber 510 and connected to a second ("soaking") recirculation pump 535 operable to cause the liquid located in the second input recirculation duct 550 to be conveyed to a second ("soaking") output recirculation duct 570 which is fluidly coupled with the top portion of the laundry treatment chamber 510, for example through a nozzle device 580. When the second recirculation pump 535 is activated, liquid is drawn up from the bottom portion of the laundry treatment chamber 510 and then sprayed back in the laundry treatment chamber 510 from above by means of the nozzle device 580, further increasing the laundry treatment efficiency by means of the mechanical action of the sprayed liquid.

Figure 6:
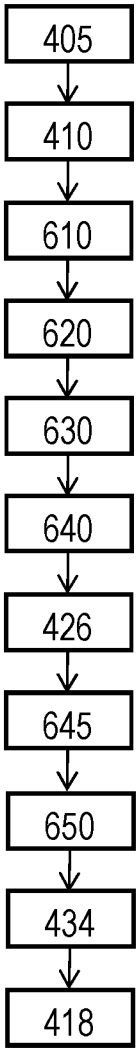
FIG. 6 is a flow chart showing operations carried out by a control unit of the laundry appliance of FIG. 5 when the treatment agent delivering device is enabled, and the intensive treatment mode is enabled.

In order to describe how the concepts of the present invention can be applied to the laundry appliance 100 equipped with the recirculation system of FIG. 5, reference will be now made to FIG. 6. FIG. 6 is a flow chart showing operations carried out by the control unit 130 when the treatment agent delivering device of said laundry appliance 100 is enabled, and at the same time the intensive treatment mode is enabled, according to an embodiment of the present invention. On this regard, phases to be described with reference to FIG. 6 which have been already described with reference to FIG. 4D will be identified with the same numeric references.

The first phase provides for the control unit 130 that selects a specific treatment cycle among the various available predetermined treatment cycles (block 405) preferably in response to an input command sent by the user, in the same way as already described with reference to FIG. 4A.

In the next phase, the control unit 130 preferably calculates an estimate of the weight of the laundry located in the laundry treatment chamber (block 410) in the same way as already described with reference to FIG. 4A.

The following phase (610) preferably provides for the control unit 130 that drives the feeding of a fixed amount of water (e.g., 1 liter) in the laundry treatment chamber; during this phase, the drum is preferably kept stationary, so that the laundry located in the laundry treatment chamber is not tumbled, and both the first and second recirculation pumps 535 and 560 are preferably kept deactivated.

Then, the control unit 130 may optionally cause the abovementioned further treatment agent, such as laundry bleach, which was manually put in advance by the user inside one of the mono-dose compartments (such as for example the mono-dose compartment 230(2)) to be fed in the laundry treatment chamber (block 620); during this phase, the drum is preferably kept stationary, and both the first and second recirculation pumps 535 and 560 are kept preferably deactivated. It has to be appreciated that, unlike the case described with reference to FIG. 4D, the (optional) feeding of the further treatment agent is carried out before the complete water loading and the treatment agent (e.g., washing detergent) feeding are carried out.

In the next phase, the control unit 130 preferably controls the feeding of a dose of treatment agent (block 630). Since the treatment agent delivering device is enabled, the control unit 130 firstly automatically calculates the dose of treatment agent to be fed in the laundry treatment chamber, and then drives the pumping system of the treatment agent delivering device to automatically take said dose from at least one multi-dose compartment (e.g., from the multi-dose compartment 220(1) in case of first auto-dosing functionality) and deliver it into the laundry treatment chamber (after being mixed with water). During this phase, the drum is preferably kept stationary, so that the laundry located in the laundry treatment chamber is not tumbled, and both the first and second recirculation pumps 560 and 535 are preferably kept deactivated.

As already described above, the dose of treatment agent calculated by the control unit 130 comprises a first amount of treatment agent calculated based on an operative condition of the laundry appliance 100. Since both the treatment agent delivering device and the intensive treatment mode are enabled at the same time, according to an embodiment of the present invention, in order to calculate the dose of treatment agent to be delivered into the laundry treatment chamber, the control unit 130 automatically adds a second amount of treatment agent to the calculated first amount of treatment agent.

The next phase (block 640) preferably provides for the control unit 130 that drives the feeding of a further fixed amount of water (e.g., 7 liter) in the laundry treatment chamber. During this phase, the control unit 130 preferably drives in rotation the drum to tumble the laundry located in the laundry treatment chamber, and preferably activates the first recirculation pump 560 (while the second recirculation pump 535 is kept preferably deactivated). The laundry tumbling combined with the liquid mixing action caused by the first recirculation pump 560 allows to obtain a better and more homogeneous mixture of water, treatment agent and (optionally) further treatment agent.

At this point, the control unit 130 controls the feeding of a further amount of water inside the laundry treatment chamber (block 426); such further amount of water is calculated by the control unit 130 in such a way that the whole amount of water actually fed into the laundry treatment chamber is preferably calibrated according to the estimate of the laundry weight previously calculated, and optionally modified based on the selected treatment cycle and/or based on parameters thereof inputted by the user or based on the actual load of laundry in the laundry treatment chamber.

In the next preferably phase (block 645), the control unit 130 causes the water located in the laundry treatment chamber to be heated until reaching a predetermined temperature (e.g., 60° C.), and the drum is preferably driven in rotation (for example, an intermittent rotation) while the the first recirculation pump 560 is preferably kept activated.

During the following phase (block 650), the drum is preferably driven in rotation by the control unit 130 to tumble the laundry located in the laundry treatment chamber for a corresponding time period (e.g., of 30 minutes, during which which the drum is preferably rotated alternatively in clockwise and anticlockwise directions). During this phase, the control unit 130 preferably activates the second recirculation pump 535 (while the first recirculation pump 560 is preferably deactivated). The (preferably, alternate) laundry tumbling combined with the mechanical action of the liquid sprayed by the nozzle device 580 further increases the laundry treatment efficiency through a more efficient distribution of the liquid throughout the laundry located in the laundry treatment chamber 510.

Then (block 434), the drum is preferably driven in rotation by the control unit 130 to tumble the laundry located in the laundry treatment chamber for another corresponding time period (for example, for 5 minutes).

Then, the control unit 130 drives the laundry appliance 100 to carry out the remaining set of phases of the selected treatment cycle (block 418). As already described with reference to FIG. 4A, this set of phases depends on the specific treatment cycle which has been selected, and usually comprises at least a treatment phase in which laundry located in the laundry treatment chamber together with the water and the dose (in this case comprising both the calculated first and second amounts) of treatment agent previously fed is treated by means of tumbling. Other phases may comprise, among the others, heating of the water at proper temperatures, rinsing and/or spinning of the laundry.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A laundry appliance comprising:

a laundry treatment chamber configured to receive laundry;

a control unit configured to, for a selected treatment cycle among a set of treatment cycles, cause the laundry appliance to perform a first set of phases of the selected treatment cycle for treating the laundry located in the laundry treatment chamber using a dose of a treatment agent, a treatment agent delivering device configured to store an amount of a treatment agent sufficient for performing a plurality of said treatment cycles and to deliver the treatment agent when enabled, the control unit being further configured to:

upon receiving a first command that enables the treatment agent delivering device:

calculate a first amount of treatment agent based on an operative condition of the laundry appliance, said dose comprising said first amount of treatment agent, and cause the treatment agent delivering device to draw up from the stored amount of treatment agent said dose and to deliver it to the laundry treatment chamber;

upon receiving a second command that enables an intensive treatment mode, cause the laundry appliance to perform a second set of phases for treating the laundry in addition to said first set of phases, wherein the control unit is further configured to calculate a second amount of treatment agent when both the first command and the second command are received, so that, when both the first command and the second command are received, said dose comprises said first amount of treatment agent plus said second amount of treatment agent.

2. The laundry appliance of claim 1, wherein the control unit is configured to calculate said first amount of treatment agent based on at least one among:

an indication/estimation/measure of a weight of the laundry located in the laundry treatment chamber;

the selected treatment cycle;

a predetermined base amount of treatment agent; and an indication/estimation/measure of a laundry dirt degree.

3. The laundry appliance of claim 1, wherein the control unit is configured to calculate said second amount of treatment agent for setting it to a value based on the calculated first amount of treatment agent.

4. The laundry appliance of claim 3, wherein the control unit is configured to calculate said second amount of treatment agent for setting it to a value corresponding to a percentage of the calculated first amount of treatment agent.

5. The laundry appliance of claim 1, wherein said first set of phases of the selected treatment cycle comprises:

a water load phase in which water is delivered to the laundry treatment chamber; and a treatment phase in which laundry located in the laundry treatment chamber, together with said water delivered in the water load phase and by using said dose, is treated by means of tumbling.

6. The laundry appliance of claim 1, wherein said treatment agent delivering device comprises:

at least one multi-dose compartment configured to store an amount of said treatment agent corresponding to multiple doses, and at least one pump unit configured to draw up said dose from said at least one multi-dose compartment and deliver said dose to the laundry treatment chamber.

7. The laundry appliance of claim 1, wherein said second set of phases of the selected treatment cycle comprises at least one of:

a first subset of phases comprising at least one additional water load phases to be carried out before said water load phase, and a second subset of phases comprising at least one further additional phase in which water in the laundry treatment chamber is heated and/or laundry in the laundry treatment chamber is tumbled after said water load phase and before said treatment phase.

8. The laundry appliance of claim 7, further comprising a compartment configured to contain an amount of a further treatment agent, the control unit being configured to deliver said amount of the further treatment agent into the laundry treatment chamber in a selected one among said first subset and said second subset of phases.

9. The laundry appliance of claim 8, wherein:

said treatment agent is laundry detergent; and said further treatment agent is laundry bleach.

10. The laundry appliance of claim 1, further comprising a user interface comprising a first input selector and a second input selector, the control unit being configured to receive said first command and said second command by means of an interaction of an user with said first input selector and said second input selector, respectively.

11. The laundry appliance of claim 1, wherein the control unit is configured to receive at least one of the first command and the second command through an external device being external to the laundry appliance.

12. A method for operating a laundry appliance comprising a laundry treatment chamber configured to receive laundry;

a control unit configured to, for a selected treatment cycle among a set of treatment cycles, cause the laundry appliance to perform a first set of phases of the selected treatment cycle for treating the laundry located in the laundry treatment chamber using a dose of a treatment agent, a treatment agent delivering device configured to store an amount of said treatment agent sufficient for performing a plurality of treatment cycles and to deliver the treatment agent when enabled;

the method comprising:

receiving a first command enabling the treatment agent delivering device at the control unit, and consequently:

calculating, by the control unit, a first amount of treatment agent based on an operative condition of the laundry appliance, said dose comprising said first amount of treatment agent, and operating, by the control unit, the treatment agent delivering device to draw up from the stored amount of treatment agent said dose and to deliver it to the laundry treatment chamber;

receiving a second command enabling an intensive treatment mode at the control unit, and consequently:

operating, by the control unit, the laundry appliance to perform a second set of phases for treating the laundry in addition to said first set of phases, and calculating, by the control unit, a second amount of treatment agent when both the first command and the second command are received, so that, when both the first and second commands are received, said dose comprises said first amount of treatment agent plus said second amount of treatment agent.

13. The method of claim 12, further comprising calculating, by the control unit, said first amount of treatment agent based on at least one among:

an indication/estimation/measure of the weight of the laundry located in the laundry treatment chamber;

the selected treatment cycle;

a predetermined base amount of treatment agent; and an indication/estimation/measure of a laundry dirt degree.

14. The method of claim 12, further comprising calculating, by the control unit, said second amount of treatment agent for setting it to a value based on the calculated first amount of treatment agent.

15. The method of claim 14, further comprising calculating, by the control unit, said second amount of treatment agent for setting it to a value corresponding to a percentage of the calculated first amount of treatment agent.

16. The laundry appliance of claim 4, wherein the percentage comprises between 5% and 40%.

17. The laundry appliance of claim 4, wherein the percentage comprises between 15% and 25%.

18. The method of claim 15, wherein the percentage comprises between 5% and 40%.

19. The method of claim 15, wherein the percentage comprises between 15% and 25%.

* * * * *